United States Patent [19]

Crafton

[11] 3,979,917

[45] Sept. 14, 1976

[54] OMNIDIRECTIONAL DRILLING SYSTEM

[76] Inventor: Paul A. Crafton, 11822 Charen Lane, Potomac, Md. 20854

[22] Filed: July 30, 1974

[21] Appl. No.: 493,142

[52] U.S. Cl. ..... 61/42; 61/84; 61/106; 299/1

[51] Int. Cl.[2] ..... E01G 3/00

[58] Field of Search ..... 61/42, 45, 84, 85, 72.1, 61/72.2; 299/14, 33; 175/11, 15

[56] References Cited

UNITED STATES PATENTS

| | | | |
|---|---|---|---|
| 1,744,102 | 1/1930 | Burke | 61/72.2 |
| 3,422,631 | 1/1969 | Silverman | 61/72.2 X |
| 3,604,215 | 9/1971 | Dunn | 61/72.2 |
| 3,713,760 | 1/1973 | Hemphill | 61/72.2 |

*Primary Examiner*—Dennis L. Taylor
*Attorney, Agent, or Firm*—Sherman & Shalloway

[57] ABSTRACT

A drilling or tunneling system in which a first, relatively large diameter bore is made, the loosened material is mixed with a stabilizing material, and a plurality of smaller permanent ducts are formed behind the boring unit.

Power, control information, stabilizing material and excess material are conveyed to and from the unit by means of a series of mobile carrier units which travel through the smaller ducts and which function in the manner of an endless conveyor.

10 Claims, 5 Drawing Figures

OMNIDIRECTIONAL DRILLING SYSTEM

BACKGROUND OF THE INVENTION

The present invention relates to a system for boring the earth and is concerned, more particularly, with the simultaneous formation of plural, parallel channels.

There are several purposes for which coextending, parallel tunnels or channels are desirable. These include, for example, highway or subway tunnels, on a large scale, and water ducts and service channels on a smaller scale, or tunnels for mining exploration and operations, or gas or oil exploration and recovery.

SUMMARY OF THE INVENTION

In general, the preferred form of boring system of the present invention includes a boring head of relatively large diameter, means for mixing a stabilizing agent with the material loosened by the boring head, forming means for forming a plurality of relatively smaller permanent channels of stabilized structural material, conveyor means within said plural channels for servicing said boring head and removing material therefrom, and advancing means bearing against the walls of said plural channels for advancing and steering said boring head.

OBJECTS OF THE INVENTION

It is an object of the invention to provide a boring system which forms a plurality of stabilized channels from a single boring operation.

It is another object of the invention to provide a boring system which forms a plurality of channels which accommodate an endless type conveyor for servicing the boring head and for removing materials from the boring head.

It is a further object of the invention to provide a boring system which forms a plurality of stabilized, permanent bores or channels and utilizes said plural channels for the propulsion of the boring unit and for effecting changes in the direction of the boring unit.

It is a still further object of the invention to provide a boring system which forms a plurality of self-lined, permanent parallel channels.

A still further object of the invention is the provision of a boring system which forms a plurality of parallel, permanent self-lined channels having helical inner surfaces, and the utilization of the helical surfaces for propulsion and steering of the boring unit through the ground.

A further object of the invention is the provision of a boring system which forms a plurality of parallel, permanent self-lined channels having helical inner surfaces, and the utilization of the helical surfaces for the propulsion of mobile carrier or conveyor units to and from the boring unit.

BRIEF DESCRIPTION OF THE DRAWINGS

These and other objects of the invention may be better understood from the following description and the accompanying drawings, in which.

DETAILED DESCRIPTION OF THE PREFERRED EMBODIMENT

Figures 1, 5:
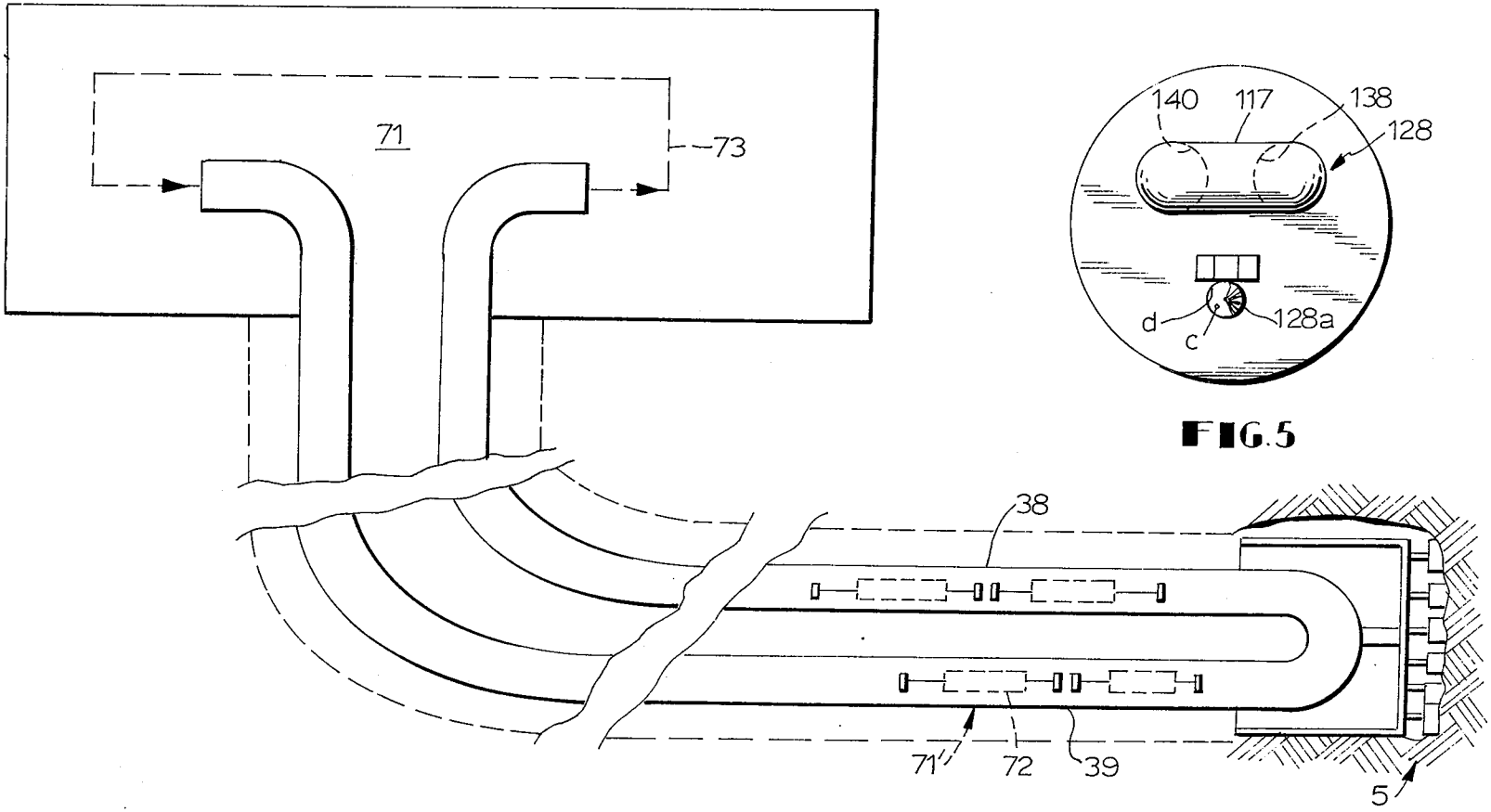
FIG. 1 is a schematic view of the preferred form of boring systems of the present invention.
FIG. 5 is a front view, partly cut away, showing a modified form of boring unit according to the invention.
Figure 2:
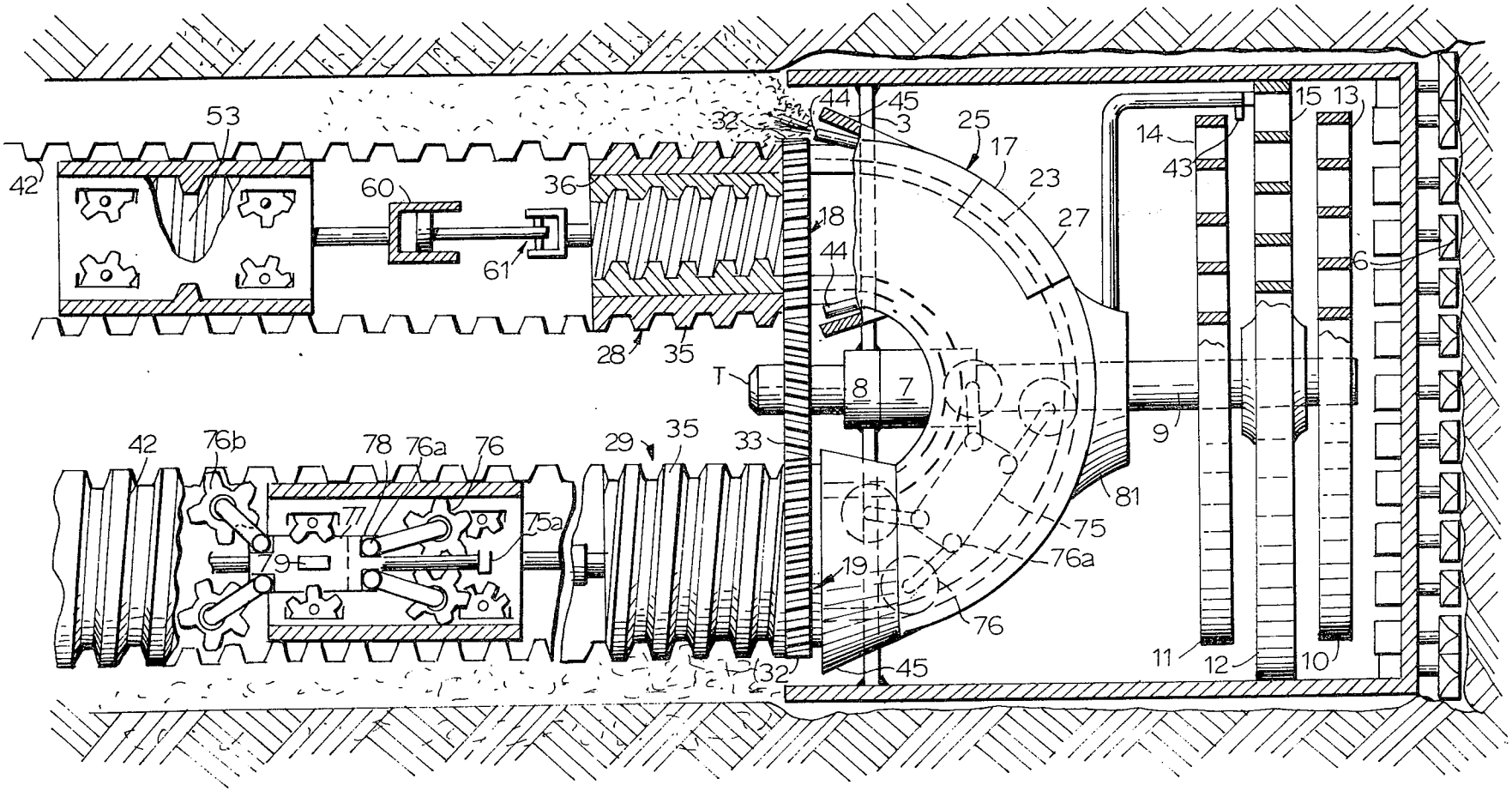
FIG. 2 is a sectional view of the preferred form of boring unit of the invention.
Figure 3:
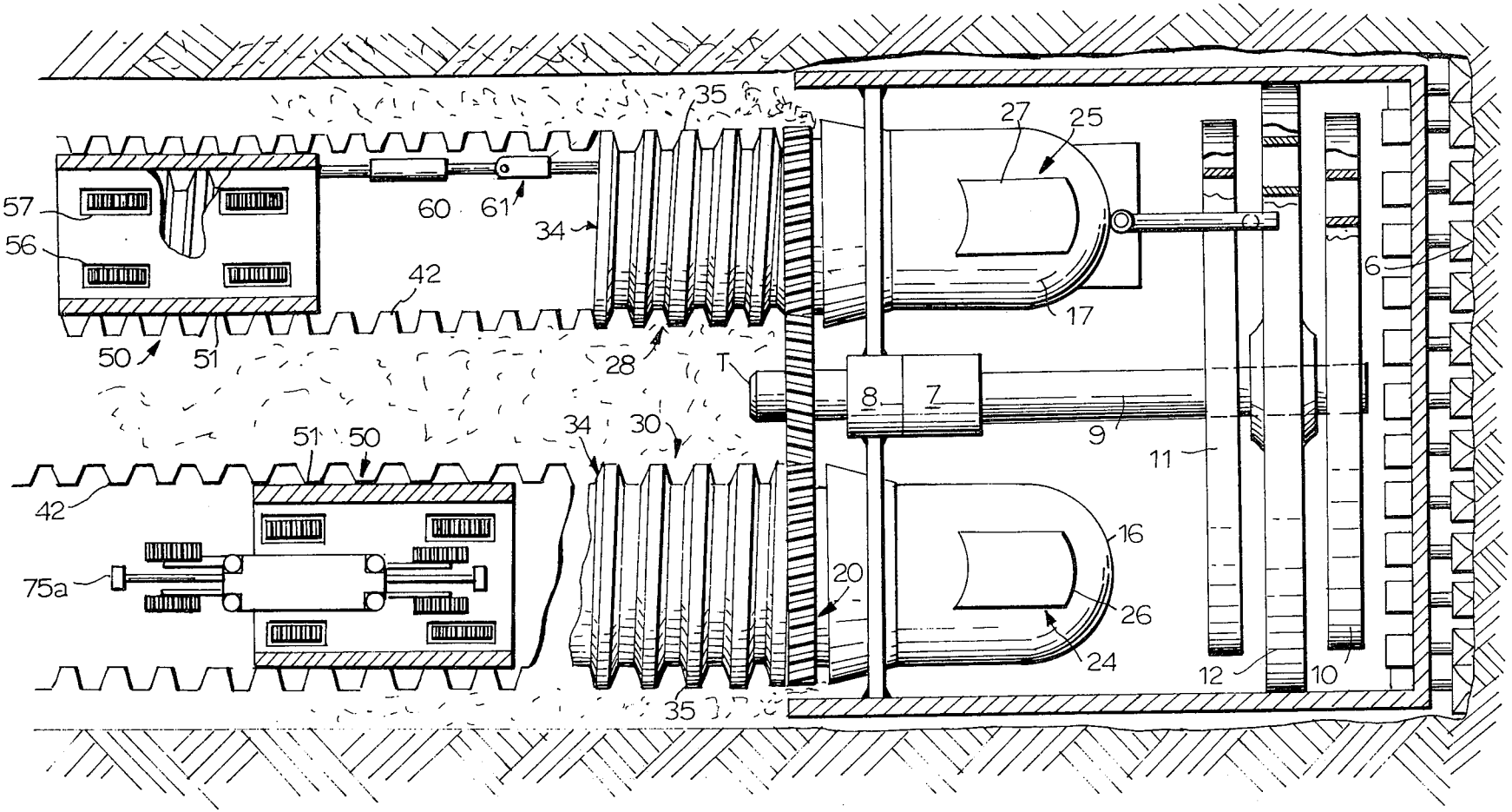
FIG. 3 is a plan view of the boring unit of FIG. 2 and taken along lines 3—3 of FIG. 2.

As shown in FIGS. 1–4, the preferred form of the present invention includes a boring unit 1 including a cylindrical casing 2 having a rear base frame 3 and an open front end 4. A boring head 5 is positioned at the open front end 4 and is sized to produce a bored diameter D which is substantially larger than the diameter of the casing 2 to permit turning of the casing within the bore, as will be discussed more fully hereinafter.

The particular cutting means of the boring head 5 is not of crucial importance to the present invention. Multiple drilling cutters 6 are shown, but it is to be understood that lasers, ultrasonic vibrators, thermal devices or any effective cutting means may be employed on the boring head 5.

A motor 7 is mounted centrally on the hub 8 of base frame 3 and has a shaft 9 extended forwardly to terminate immediately behind the boring head. The shaft 9 carries a pair of spaced macerator plates 10 and 11 fixed thereon for rotation, and an intermediate, generally static macerator plate 12. The macerator plates 10, 11 and 12 are provided with shearing apertures 13, 14 and 15, respectively, which preferably are diametrically staggered with respect to each other, to improve the shearing and mixing of the loosened material.

The base frame 3 mounts a pair of U-shaped tubes 16 and 17 which communicate with four tunnel apertures 18, 19, 20 and 21 which are uniformly distributed in relation to the base frame 3.

Internally, the hollow U tubes have helical surfaces or tracks 22 and 23, respectively, which serve as traction means, as will be discussed more fully hereinafter. The U tubes 16 and 17 have access apertures 24 and 25, respectively, which open to the interior thereof and are provided with sliding covers 26 and 27, respectively, as discussed more fully hereinafter.

The base frame 3 mounts a plurality of forming members 28, 29, 30 and 31 mounted for rotation about the apertures 18, 19, 20 and 21, respectively. The forming members each carry a gear 32 mounted rotatably thereon and which meshes with a central drive gear 33 which is driven by the motor 7 through the hub of the base frame 3. If desired, the drive gear 33 may have a separate motor, or may receive power via a variable speed transmission T as shown. Similarly, the several gears 32 may have individual motors or drives, if desired.

It is preferred that the several gears 32 and the drive gear 33 have helical teeth, since they will be working in loose material. Additionally, it is advantageous to form the other surfaces of the gears 32 and 33 with an extremely hard material, or to apply a hard facing thereto, so that the gears may act as crushers for any rock bits which may enter therebetween, the helical threads then permitting escape of the crushed particles.

Externally, the forming members each carry a molding sleeve 34 which is keyed to or integral with its respective gear 32 and carries a helical outer surface 35 which also preferably is formed or coated with an extremely hard surface material. The molding sleeves 34 are journalled on the cylindrical outer surface 36 of their respective forming members 28, 29, 30 and 31, while their helical, external surface 35 bears against the surrounding earth or earth mixture to form the mixture into ducts 38, 39, 40 and 41, respectively. The rotation of the sleeves 34 is correlated to the rate of advance of the boring unit and the pitch of the helices 35 to avoid smearing of the walls of the ducts 38–41.

The ducts 38–41 each carry a helical inner surface 42 which is stabilized into structural material by the addition of suitable binding agents such as settable resin mixtures, concrete and additives or aggregates. I prefer to add and mix an epoxy material at one of the macerator plates 10–12 and, preferably, through ducts 43 on the static macerator plate 12. A catalyst is then supplied via ducts 44 to the earth/epoxy mixture, behind skirts 45 on each leg of the U tubes just prior to the mixture interface with the helical surfaces 35 so that the earth/epoxy/catalyst mixture will "set" during the time it is formed against the forming members into the several ducts 38–41. The stabilized or rigidified, structural material then carries the permanent, integral helical surfaces 42 on the surface of each of the ducts. The skirts 45 also serve to guard the meshing zone of each of the gears 32 with the drive gear 33.

Within each of the ducts 38–41, a traction unit 50 engages the adjacent of the forming members 28–31. Each traction unit 50 includes a cylindrical frame or sleeve 51 which has a cylindrical outer surface 52 which closely but loosely fits within the helical surface 42.

The sleeves 51 also have a helical inner surface 53, and have eight slots 54, 54′, 55, 55′, 56, 56′, and 57, 57′, respectively, which are arranged on widely-spaced chordal lines "C", with respect to the cylindrical outer surface 52, and which form four pairs of traction ports.

Each traction port has a traction gear 58 extended therethrough to engage the helical inner surface 42 of the ducts 38 – 41 in which the traction unit is positioned. One or more of the traction gears 58 are driven by any suitable means, such as electrical axle-motors 59 mounted on the sleeve 51.

Each traction unit 50 includes at least one hydraulic cylinder 60 engaged between its sleeve 51 and the fixed portion of its associated forming member. A degree of angular freedom is necessary between the traction units 50 and their associated forming member, to permit differential thrust by the traction units 50 and thereby to provide for steering of the boring unit. I prefer to include universal joints 61 for this purpose, and to control the cylinders 60 via a system to be discussed more fully hereinafter.

The system includes an endless type of conveyor system 70 having an access or service zone 71 at ground level and which includes at least one pair of the parallel ducts 38–41 formed by the boring unit head and joined or connected in pairs by one of the U tubes 16 or 17.

Where one tube pair is used, it serves both for the supply of the boring unit and for the removal of excess earth material equivalent to the volume of the formed ducts 38–41. However, depending on the circumstances, a conveyor 70 in one tube pair may be used to supply the boring unit, while a second conveyor 70′ in the other pair may be used for supply and retrieval of loose material, such as, for example, the supply of fill material and the removal of ore, in a mining operation.

The conveyor 70 includes an indefinite plurality of conveyor or mobile carrier units 72, the number thereof being a function of the lengths of the system, with additional units being added at the service zone 71 as advancement of the boring unit requires. For this purpose, the "endless" conveyor includes a service loop 73 at the service zone 71 to permit removal, emptying, or servicing of returning mobile carrier units and the filling, servicing and insertion of mobile carrier units for departure to the boring unit.

Each mobile carrier unit 72 includes a casing 75 and a plurality of gear wheels 76 which are resiliently mounted thereon, such as by spring mounts shown schematically at 77. One or more of the gear wheels is driven by suitable means, such as the electrical axle motors 78 shown.

It is to be understood that the traction gears 58, on traction units 50 and the gear wheels 76, on mobile carrier units 72, are formed essentially as helical gears. Therefore, they move substantially linearly through the ducts 38–41, so that the main structures of the traction units 50 and the mobile carrier units 72 are not spiralled through the system, but move axially therethrough with only incidental, negligeable rotation with regard to the helical surfaces within which they travel.

Each mobile carrier unit casing 75 includes a service zone 77 and a carrier zone 78. The service zone 77 may have any suitable access port 79 or means for the insertion of a power unit, such as a battery (not shown) for its propulsion system, encoded control "information" for guidance or regulation of the boring unit, or similar servicing matter.

The carrier zone 78 includes an access door 80 for the filling and discharging of the materials to supply materials to the boring unit and then to remove matter from the boring unit, as desired.

The casings of the mobile carrier units 72 are arranged to abutt each other, if it becomes necessary, by extensions **75*a*** thereof between sets of gear wheels. Therefore, if any given mobile carrier unit loses tractive power, for any reason, it will be pushed forward by one of more of its following mobile carrier units.

Figure 4:
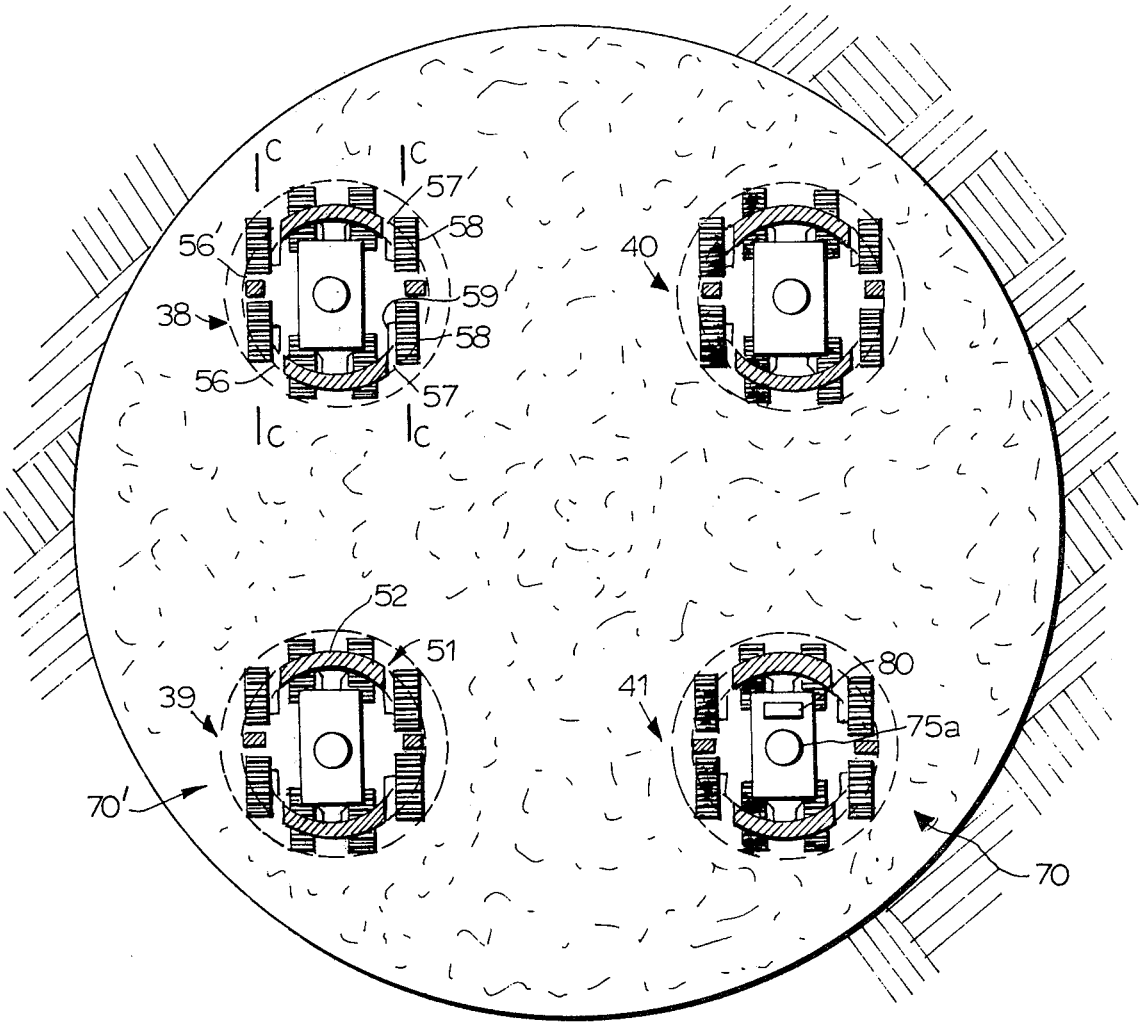
FIG. 4 is a cross-sectional view of the boring unit of FIG. 2 and taken along the lines 4—4 of that Figure.

As can best be seen in FIG. 4, the mobile carrier units 72 are dimensioned so that they are able to pass through the central bore in the sleeves 51 of the traction units 50. As in the several ducts 38–41 and in the U tubes 16 and 17, the gear wheels 76 of the mobile carrier units 72 mesh with the helical inner surfaces 53 of the traction-unit sleeves 51 in order to continue progression of the mobile carrier units through the interior of the traction unit.

The U tube 17 carries a control casing 81 on its forward surface, which houses the controls for the boring head 5, the macerators 10–12, the soil stabilizing supply via 43 and 44, the drive gear 33 and the several traction units 50 in the ducts 38, 39, 40 and 41.

OPERATION OF THE PREFERRED SYSTEM

For straight-line boring, the several traction units 50 are driven at the same speed, and their respective hydraulic cylinders 60 are maintained in equilibrium. When it is desired to turn the boring unit, selected traction units may be driven at slightly different speeds, or their hydraulic cylinders imbalanced, or both, as may be desired.

For example, if it is desired to turn the boring unit down, as viewed in FIG. 1, the hydraulic cylinders 60 in upper ducts 38 and 40 are pressurized to extend toward their full length, while those in ducts 39 and 41 are relieved to permit their collapse or shortening. The resulting bias relieves cutting pressure on the lower of the drilling cutters 6, thereby diverting the boring head downward.

It can be seen that the boring unit may be turned on many axes, including axis 38/40 mentioned above, axis 38/41, axis 39/40, axis 38/39 and axis 40/41. Therefore, the path of the boring unit is omnidirectional, in that it may follow any curvilinear path.

The control unit 81 communicates with the several controlled units via conventional communication and supply lines (not shown). It is desirable, however, that the control wires, supply conduits, lubrication lines and the like be protected by rigid structures or reinforcement to prevent damage.

While a variety of control systems may be used to operate and direct the boring unit, I prefer to use magnetically-encoded "cards" or the like, which transmit their encoded "information" to a reader or sensing unit, in the control unit 81, as they pass adjacent thereto in the U tube 17.

I prefer to include a "fail safe" sensing system in the boring unit to, for example, delay further operation of the boring head in case of misoperation of any portion of the boring unit, until corrective instructions are received via the conveyor system 70, and normal operation can be resumed.

The control unit 21 thus is instructed, by the information received via the conveyor system 70, regarding the direction of the boring unit; the removal of material from the storage zones 78 of the mobile carrier units; the retrieval of matter from the boring unit via the storage zones of returning mobile carrier units; the modification of the rate of supply of epoxy or other stabilizing matter when different soil formations are encountered, and such other functions as are necessary to the operation of the boring unit.

Alternatively, or as an emergency control, the control unit may include a radio transceiver for sending and receiving information.

A modified form of the invention is shown in FIG. 5, in which the boring unit includes one U tube 117 connecting forming members 128 for two large ducts 138 and 140 having an endless conveyor 170 therein, and a relatively smaller forming member 128*a* for a single, smaller duct *d*, the three ducts preferably being spaced on radii about 120° apart.

In the system shown in FIG. 5, the smaller duct *d* may serve as a conduit for a gradually-lengthening communication cable *c*, during the boring operation, and may then be converted into a drainage duct after the boring operation is completed.

Therefore, it is apparent that the present invention provides a particularly advantageous method and system for boring the earth, forming a plurality of permanent, parallel ducts behind the boring unit, and is capable of remote control without constant attention of workmen or engineers "down the hole".

Further, by converting the walls of the permanent ducts into impervious, structural material against a progressing or "slip" form, the need for tunnel linings, dismountable forms or subsequently cast linings, with interim dangers of collapse, is obviated.

Various changes may be made in the details of the invention, as disclosed, without sacrificing the advantages thereof or departing from the scope of the appended claims.

What is claimed is:

1. A method of boring the earth comprising advancing a boring unit of a first diameter through the earth to form a closed-periphery bore by loosening material from a work face;

treating the material loosened by said advancing boring unit to form a structural material thereof; and forming said structural material into a plurality of relatively smaller permanent ducts behind the advancing boring unit.

2. The method of claim 1 including adding a stabilizing material to form a portion of said structural material.

3. The method of claim 1 including the step of forming a non-cylindrical inner surface in at least one of said permanent ducts and driving the advancing boring unit by engagement with said inner surface.

4. The method of claim 3 including forming the non-cylindrical surfaces into a helix.

5. The method of claim 3 including forming three permanent ducts spaced on radii about 120° from each other.

6. The method of claim 4 including forming four permanent ducts.

7. The method of claim 1 including supplying said boring unit through one of said permanent ducts and removing matter from said boring unit via a second of said permanent ducts.

8. The method of claim 7 including supplying control information to said boring unit through said first permanent duct and receiving information from said boring unit through said second permanent duct.

9. A method of boring the earth including advancing a boring unit through the earth to form a closed-periphery bore by loosening material from a work face, treating the material loosened by said advancing boring unit to form a structural material thereof, forming said structural material into a permanent duct having a helical inner surface, and employing said helical inner surface as a gear member in advancing said boring unit.

10. The method of claim 9 including adding a stabilizing material to form a portion of said structural material.

* * * * *